US005688376A

United States Patent [19]

Van Egmond et al.

[11] Patent Number: 5,688,376

[45] Date of Patent: Nov. 18, 1997

[54] METHOD FOR THE GAS SEALING MANUFACTURE OF A DOOR FRAME OF A COKE OVEN BATTERY AND SUCH A DOOR FRAME STRUCTURE

[75] Inventors: Jacobus Hermanus Maria Van Egmond, Alkmaar; Hans Willem Smits, Bennebroek, both of Netherlands

[73] Assignee: Hoogovens Staal BV, Ijmuiden, Netherlands

[21] Appl. No.: 585,101

[22] Filed: Jan. 16, 1996

[30] Foreign Application Priority Data

Jan. 17, 1995 [NL] Netherlands ..... 9500081

[51] Int. Cl.[6] ..... C10B 47/00; C10B 57/00

[52] U.S. Cl. ..... 201/1; 201/5; 201/18; 202/242; 202/248; 110/173 R

[58] Field of Search ..... 202/248, 269, 202/242, 267.1; 201/1, 5, 18; 110/173 R

[56] References Cited

U.S. PATENT DOCUMENTS

| | | | |
|---|---|---|---|
| 3,557,659 | 1/1971 | Harris | 409/178 |
| 4,176,013 | 11/1979 | Garthus et al. | 202/242 |
| 4,410,399 | 10/1983 | Holz et al. | 202/248 |
| 4,412,891 | 11/1983 | Abendroth | 202/248 |
| 4,439,277 | 3/1984 | Dix | 202/248 |
| 4,749,446 | 6/1988 | van Laar et al. | 202/139 |

FOREIGN PATENT DOCUMENTS 875 340 4/1953 Germany .

OTHER PUBLICATIONS

Patents Abstracts of Japan, JP61223087, Oct. 3, 1986.

*Primary Examiner*—Nina Bhat
*Attorney, Agent, or Firm*—Larson & Taylor

[57] ABSTRACT

Method for the gas sealing manufacture of a door frame of a coke oven battery which battery comprises a refractory structure with an armor plate connected to it onto which the door frame is fitted characterized by the following steps:

measuring the profile of the surface of the armor plate at the position where it faces the door frame in its mounted state;

fitting a profile to one side of the door frame which in its mounted state faces the armor plate, corresponding to the profile of the surface of that armor plate measured in the previous step, in such a way that in its mounted state the door frame rests essentially against the armor plate;

placing the door frame thus adapted against the armor plate.

2 Claims, 3 Drawing Sheets

METHOD FOR THE GAS SEALING MANUFACTURE OF A DOOR FRAME OF A COKE OVEN BATTERY AND SUCH A DOOR FRAME STRUCTURE

FIELD OF THE INVENTION

The invention relates to a door frame structure of a coke oven battery and to a method for the gas sealing manufacture of a door frame of a coke oven battery which comprises a refractory structure with an armour plate connected to it onto which the door frame is fitted.

BACKGROUND OF THE INVENTION

Such a door frame structure and coke oven battery is known from DE-C-875340.

For decades means have been sought for countering the environmental pollution caused by coke oven plants. An example of one problem are the emissions into the atmosphere occurring as a result of leaks.

A coke oven battery is provided with a series of combustion chambers and coking chambers set up alternately and to coordinate with one another. During operation the coking chambers are filled with coking coal to be fired into coke, and during the firing process closed off with doors. The doors sealing off the coking chambers are fitted in frames. In order to obtain a good emission-free seal it is important that these frames are straight and flat. The greater the deformation the greater the problems with sealing. The relatively loose structure of the frame makes it adopt the shape of the mounting surface lying behind it. In general it can be said that where a deviation exceeds 25 mm a good seal is no longer possible.

Deformation of the steel structure (the armour plates) of coke oven batteries is caused by the slow "growing" of the refractory structure lying behind. The growing is caused because graphite forms in the (hairline) cracks of the refractory structure. This process is influenced by whether or not the refractory material is pressed in or retained adequately. In this way over time an initially leakproof door frame structure will start to display leaks.

In accordance with the known state of the art gas tight repair of the structure is only possible by making the mounting surface straight again since the frame follows its shape. This requires comprehensive renovation of the structure lying around the door whereby both refractory and steel structures often have to be replaced. This means high repair costs. Moreover the oven has to be out of operation for a long time, even for several weeks, which also means a big loss of production.

SUMMARY OF THE INVENTION

With the invention it is now intended to create a solution for the gas sealing repair while avoiding the above mentioned disadvantages. In accordance with the invention this is achieved because the side of the door frame facing the refractory structure is formed to match the surface of the armour plate against which the door frame is attached.

In practice this structure is made by applying the following working steps:

measuring the profile of the surface of the armour plate at the position where it faces the door frame in its mounted state;

fitting a profile to one side of the door frame which in its mounted state faces the armour plate, corresponding to the profile of the surface of that armour plate measured in the previous step, in such a way that in its mounted state the door frame rests essentially against the armour plate;

placing the door frame thus adapted against the armour plate.

Once these steps have been carried out, the front of the door frame is sufficiently straight and flat for a good seal to be possible between the door frame and door so that gas leaks to the surroundings during operation are effectively countered.

BRIEF DESCRIPTION OF THE DRAWINGS

The invention will be illustrated by reference to the drawing.

DESCRIPTION OF THE PREFERRED EMBODIMENTS

Figure 1:
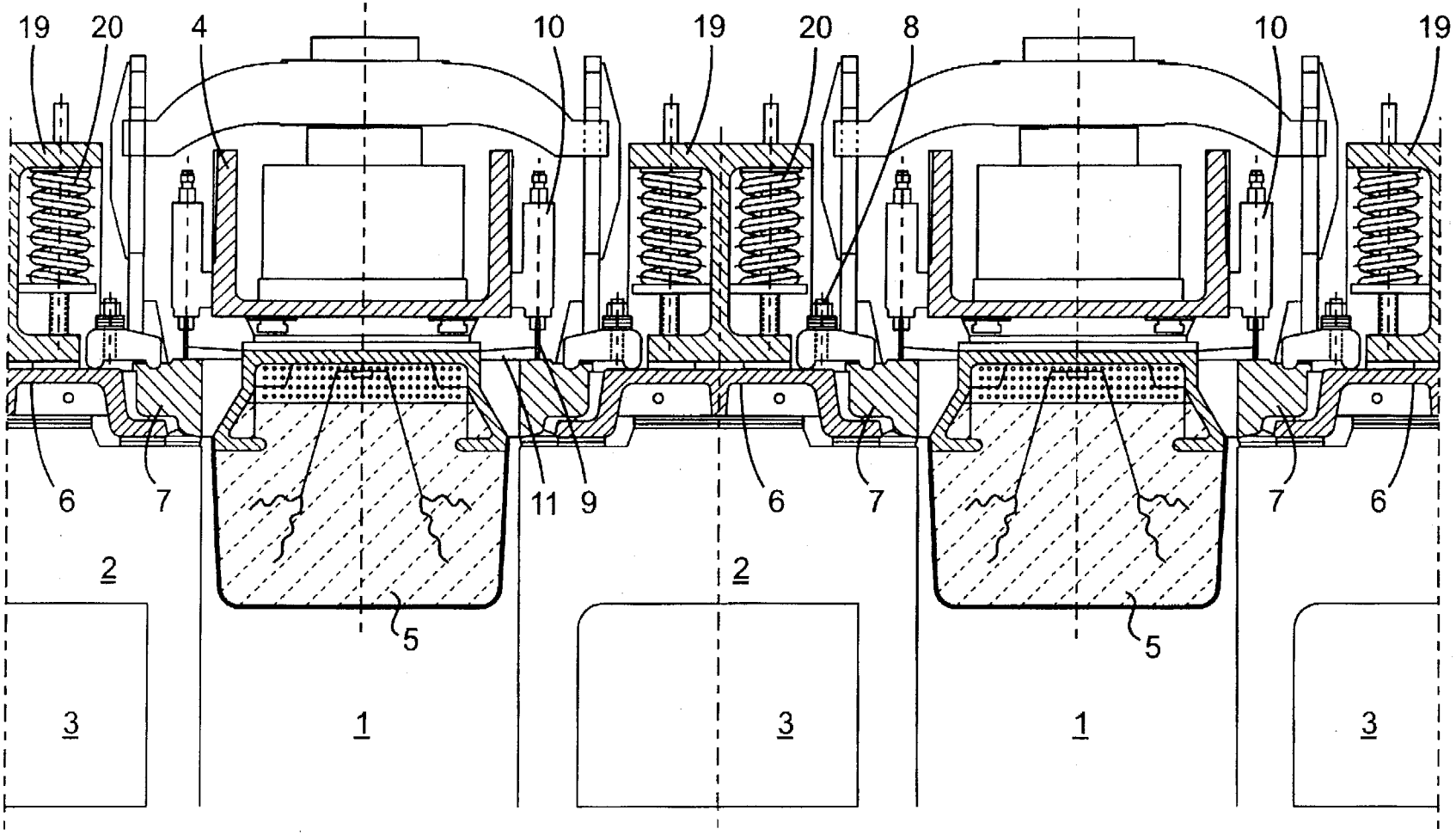
FIG. 1 shows a horizontal cross-section of a part of a coke oven battery at the position of the door openings in an embodiment in accordance with the known state of the art.

FIG. 1 shows a part of a coke oven battery with a number of coking chambers (1) and combustion walls (2) lying between the coking chambers. The combustion walls (2) are made in refractory brickwork into which combustion chambers (3) are recessed.

Coking coal is fired into coke in the coking chambers (1). During operation the coking chambers then still filled with coking coal are closed off by coke oven doors (4) which reach into the coking chambers with a door plug (5).

The front sides of the combustion walls (2) are covered with metal armour plates (6) which are held pressed against the refractory brickwork by buckstays (19) and anchors (20) in order to support and hold together the refractory brickwork. The openings of the coking chambers (1) are framed by metal door frames (7). The door frames (7) are held pressed against the armour plates (6) by means of pressing (8). Leaks occur in those places where the door frame and armour plate do not join together well. A further sealing structure is fitted between the door frames (7) and the coke oven doors (4) which comprise knives (9), the knife edges of which are held pressed against the door frames (7) by the spring structure (10). In the case of the specific embodiment shown in FIG. 1 the knives (9) are joined gastight to the coke oven door (4) by means of diaphragm (11).

In accordance with the known state of the art, there is a sealing structure (16, 17) fitted between the door frames (7) and the armour plates (6) for preventing gas from leaking out of the coking chambers and into the surroundings through the gap remaining between the door frames (7) and the armour plates (6).

Figure 2:
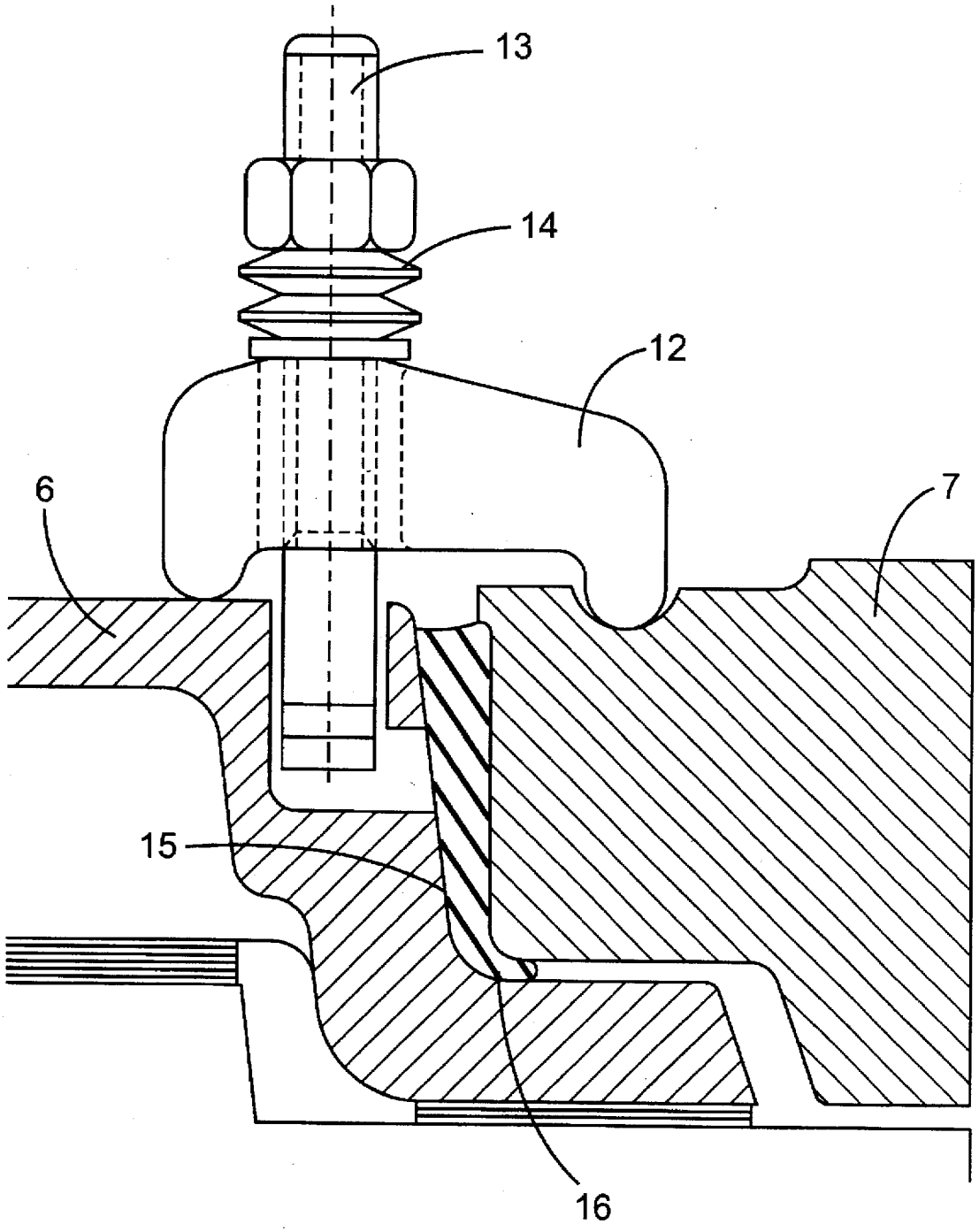
FIG. 2 shows a detail of the sealing structure of armour plate and door frame in accordance with the known state of the art.

FIG. 2 shows the known sealing structure between door frame (7) and armour plate (6) in accordance with a first embodiment. The door frames (7) are held pressed against the armour plates (6) by means of cleats (12), hammer-head bolts (13) and cup springs (14). Felt is usually placed between the door frames (7) and the armour plates (6) for encouraging the structure to lie well. After the door frame (7) is fitted into the opening of a coking chamber the wedge-shaped gap (15) is usually filled with a sealing cord (16) that is hammered into the wedge-shaped gap.

Figures 3, 3A:
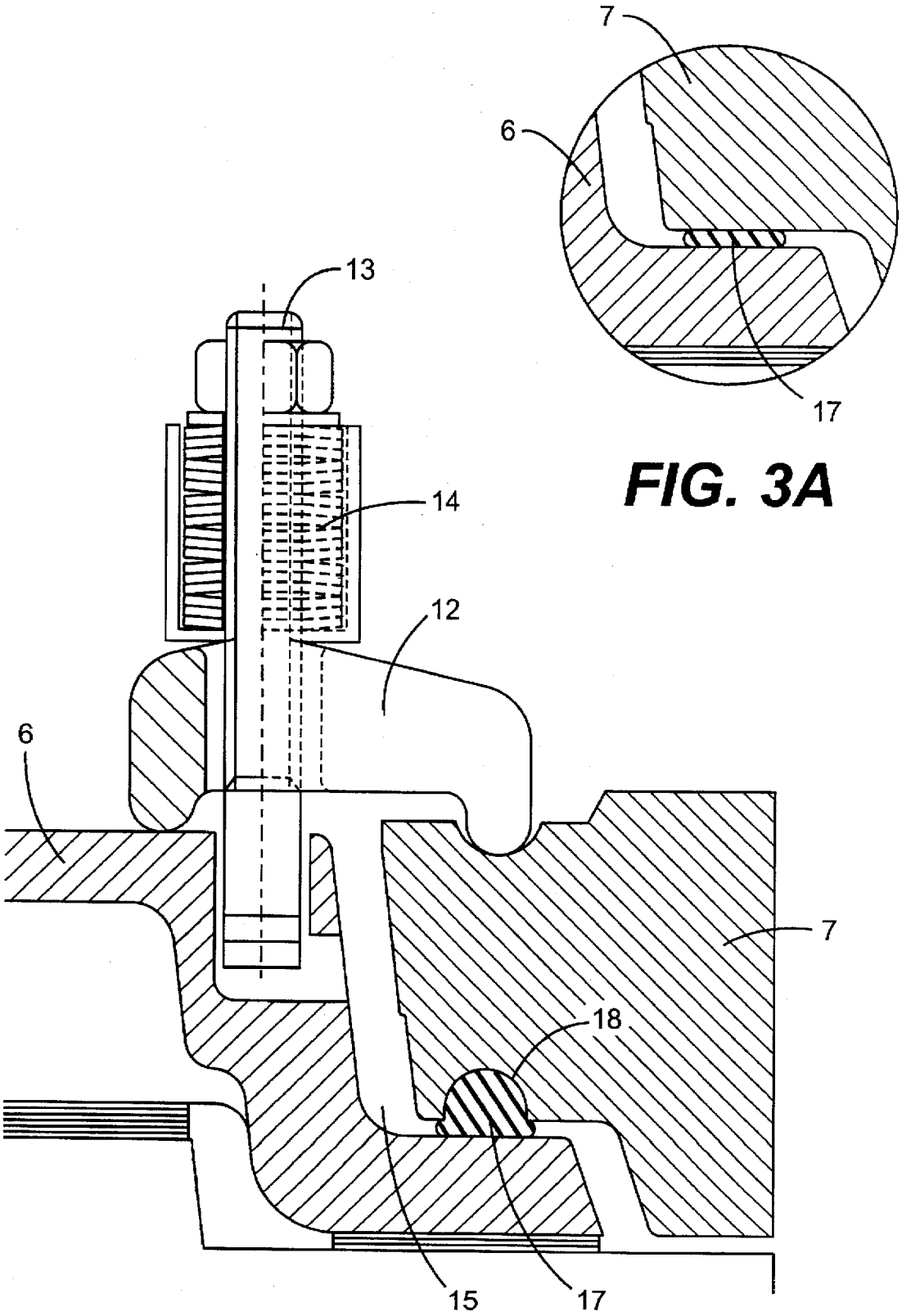
FIG. 3 shows a detail of an alternative sealing structure of armour plate and door frame in accordance with the known state of the art.
FIG. 3A shows a detail of still another alternative sealing structure of armor plate and door fame in accordance with the known state of the art.

FIG. 3 shows another known sealing structure between door frame (7) and armour plate (6). Behind the door frame (7) the means of sealing (17) is fitted between door frame (7) and armour plate (6) in the place where the door frame (7) and armour plate (6) are resting. In the case of this embodiment the means of sealing (17) are preferably a chord that is fitted in a groove (18) of door frame (7). It is possible to omit the groove (18) to allow the means of sealing (17') to rest directly against the door frame (7') and armour plate (6) as shown in detail of FIG. 3A.

During operation the refractory structure (2) expands in an irregular fashion so that the armour plates (6) adopt a form which no longer closes against the door frame (7). Leaks then result between armour plate (6) and door frame (7).

In accordance with the invention this may be remedied by carrying out the following method:

measuring the profile of the surface of the armour plate at the position where it faces the door frame in its mounted state;

fitting a profile (for example by a metal-removing process) to one side of the door frame which in its mounted state faces the armour plate, corresponding to the profile of the surface of that armour plate measured in the previous step, in such a way that in its mounted state the door frame rests essentially against the armour plate;

placing the door frame thus adapted against the armour plate.

It is believed that the door frame structure shaped in accordance with the invention as described above is clear to the specialist and does not need to be shown in further detail in the drawing.

In a practical embodiment of the invention it has been found that the remaining deviation of the repaired structure against which the door frame is to be rested can be less than 2 mm relative to a straight line. With this margin of deviation an optimum result can be achieved in terms of gas tightness because of the other tolerances of accuracy in the structure.

What is claimed is:

1. A method for producing a door frame for repair of a coke oven battery which door frame has a mating surface which is in a gas-tight mating relationship with a first surface of an armor plate, said armor plate having a second surface in contact with a refractory structure which forms a part of the coke oven battery, comprising the steps of:

measuring a profile of the first surface of the armor plate;

shaping the mating surface of the door frame to match the measured profile of the first surface of the armor plate; and mounting the door frame with the shaped mating surface of the door frame in contact with the first surface of the armor plate to provide a gas-tight seal between the shaped first surface of the door frame and the armor plate.

2. A coke oven battery made by the process of claim 1 comprising:

a refractory structure which forms at least a portion of the coke oven battery;

an armor plate having a first surface and a second surface which is opposite the first surface and in contact with the refractory structure;

a door frame which is designed to have a gas-tight fit with the armor plate, said door frame having a mating surface which faces and engages the first surface of the armor plate when the door frame is mounted in the battery to provide a gas-tight seal, said mating surface of said door frame being shaped to closely match a predetermined profile of the first surface of the armor plate; and a door in sealing engagement with the door frame.

* * * * *